United States Patent [19]

Debeuckelaere

[11] 4,154,039

[45] May 15, 1979

[54] REINFORCED BUILDING STRUCTURE AND METHOD OF MANUFACTURE

[75] Inventor: Valere Debeuckelaere, Zwevegem, Belgium

[73] Assignee: N. V. Bekaert S.A., Zwevegem, Belgium

[21] Appl. No.: 769,329

[22] Filed: Feb. 16, 1977

Related U.S. Application Data

[63] Continuation of Ser. No. 365,613, May 31, 1973, abandoned.

[30] Foreign Application Priority Data

Jun. 1, 1972 [GB] United Kingdom ..... 25740/72

[51] Int. Cl.[2] ..... E04C 2/06

[52] U.S. Cl. ..... 52/454; 52/612; 52/659; 264/35; 52/741

[58] Field of Search ..... 52/612, 344, 351, 454, 52/452, 443, 659, 741; 425/DIG. 121; 264/35

[56] References Cited

U.S. PATENT DOCUMENTS

| | | | |
|---|---|---|---|
| 532,037 | 1/1895 | Doehring | 52/612 |
| 619,769 | 2/1899 | Lillenthal | 52/335 |
| 1,037,321 | 9/1912 | Rives | 52/454 |
| 1,846,874 | 2/1932 | Kahn | 52/454 |
| 3,289,371 | 12/1966 | Pearson | 52/741 |
| 3,324,611 | 6/1967 | Gamber | 52/741 |
| 3,429,094 | 2/1969 | Romualdi | 52/659 |
| 3,808,085 | 4/1974 | Givens | 52/659 |
| 3,868,296 | 2/1975 | McKeon | 52/612 |

FOREIGN PATENT DOCUMENTS

| | | | |
|---|---|---|---|
| 1086630 | 10/1967 | United Kingdom | 52/344 |

OTHER PUBLICATIONS

*Red Book of Lathing & Plastering* ©1967, U.S. Gypsum Company pp. 84–99, 168 and 169.

Journal of the American Concrete Institute, Jun. 1964, pp. 657–670.

*Primary Examiner*—Price C. Faw, Jr.
*Assistant Examiner*—Henry Raduazo
*Attorney, Agent, or Firm*—Shlesinger, Arkwright, Garvey and Dinsmore

[57] ABSTRACT

The invention is a building structure of material which uses a water-activated binder, such as cement-mortar or concrete, and of a form having one thickness dimension much smaller than the other two dimensions perpendicular thereto. The structure includes a substrate sheet extending along a surface substantially perpendicular to the thickness dimension and a layer of the water activated binder material having a multiplicity of short metal wire reinforcing elements distributed therein.

7 Claims, 5 Drawing Figures

REINFORCED BUILDING STRUCTURE AND METHOD OF MANUFACTURE

This is a continuation of application Ser. No. 365,613, filed May 31, 1973 now abandoned.

This invention relates to a building structure of material which uses a water-activated binder, such like cement-mortar or concrete, and of a form having one thickness dimension much smaller than the two other dimensions perpendicular thereto. The form of the structure must not necessarily be flat and located in one plane. It may have the form of an incurved surface forming a complete building or only a part thereof, as will be explained hereinafter, "building" being understood in its broad sense as any construction, and not limited to constructions for housing of persons. In general the form of the surface, incurved or not, is such that throughout the surface a thickness dimension can be distinguished which is much smaller than the two other dimensions perpendicular thereot, this means, smaller than 3.g. 1/6 of the two other dimensions in which the surface is extending.

Such building structures are generally made by firstly providing a substrate sheet structure having the form of the structure to be made, and then covering at least one face of said structure with a layer of said material in soft state. Typical buildings that can be made using such building structures include fencing walls, bathing huts, changing-rooms for sports-fields, and small cottages. Substrate sheets particularly suitable for the purpose just mentioned are ones such as lath which can be cut and folded to desired shapes to form a substrate sheet structure, whether they are to be used singly or to be interconnected side by side with other and similar substrate sheets. The building structure of the invention is of this type, namely comprising a substrate sheet structure extending along a surface substantially perpendicular to said thickness dimension and comprising further on at least one face of said sheet structure a layer of said material which uses a water-activated binder. Such materials are, for instance, cement-motar or concrete.

A known type of substrate sheets is made of cardboard reinforced with a first series of parallel wires on one side and with a second series of parallel wires, at right angles to the first series, on the other side. At the wire crossings the cardboard is apertured and the crossing wires are welded together through the apertures. In order to enhance the adherence of mortar or concrete to the sheet said apertures are made large enough to allow the mortar or concrete to flow around the wire crossings in each opening. The cardboard is of a king which adheres to mortar or concrete and does not tear readily when wetted. Other forms of substrate sheet such as expanded metal or small mesh wire netting can be used so long as they allow mortar or concrete to be spread thereon and to adhere, and so long as they can be cut and folded to the desired shape of a substrate sheet structure but are nevertheless sufficiently strong to support the mortar or concrete without tearing.

It is necessary to use substrate sheets of a degree of strength which is dictated not so much by the requirement of holding the mortar or concrete without tearing, as by the desired reinforcing effect of the sheet structure in the mortar or concrete. Such strong sheets are however more difficult to cut and fold in the desired shape.

The object of the invention is to provide a better reconciliation between the requirement of reinforcement of the building structure, and the requirement of easily cutting and folding the substrate sheets. Further advantages of the invention will appear from the further description.

According to the present invention, the layer of said material on said face of the substrate sheet structure comprises a multiplicity of short metal wire elements distributed therein. It is known that a multiplicity of short metal wire elements have a reinforcing effect on the material, which, for a given type of wire element, increases almost linearly with the proportion of wire elements included. According to the invention, the function of reinforcing is at least partly taken over by the wire elements, in such a way that the substrate sheet structure is allowed to be made less strong, for a given degree of final strength of the building structure. So, it is a particular advantage of the invention that substrate sheets can be used which are easier to cut and fold than ones used previously which had to be comparatively rigid in order to impart strength to unreinforced mortar or concrete. It is another advantage, when using substrate sheets of a preferred kind, whose constituant wires cross and are interconnected in the apertures of an intermediate cardboard sheet, that the wire reinforcing elements considerably improves and adherence between the mortar or concrete and the sheet where the mortar or concrete flow around the wire crossings, because the mortar or concrete is reinforced by the wire elements; similarly improved adherence occurs when the reinforced mortar or concrete is applied to other kinds of substrate sheet having surface projections or irregularities of one kind or another to improve the adherence. Moreover, the mortar or concrete applied to a relatively non-rigid substrate sheet is subject to irregular shrinkage when drying, in which the substrate sheet is caused to give way, and this results in little cracks appearing over the surface layer. The wire reinforcement however prevents the appearance of such cracks.

It has already been proposed to make building structures, of a form having a thickness dimension much smaller than the two other dimensions, by making a reinforcement netting of the same form, and by applying on at least one face thereof a layer of material, such like cement-mortar or concrete, comprising a multiplicity of short steel wire elements distributed therein. Technical Report No. 2046 "Response of fibrous-reinforced concrete to explosive loading", Department of the Army, Ohio River Division Laboratories, Corps of Engineers, Cincinnati, Ohio, January 1966. However, the reinforcement netting used together with the fiber elements was of wide mesh, only for purpose of additional reinforcement provided by the fiber elements, and not sufficiently opaue to be used as a substrate sheet. A special shuttering of the same form must be made on which the reinforcement netting and the concrete layer is applied, after which the shuttering is removed when the structure has hardened. This structure has the advantage of a combined reinforcement extending in the general plane of the structure and due to said network and a reinforcement against bending due to the fiber elements. But the network is not made sufficiently opaque in order to obtain the advantages of the combination with substrate sheets as described.

The process for making a building structure according to the invention will consequently be carried through as explained hereinabove, namely by firstly providing a substrate sheet structure and then covering at least one face of said sheet structure with a layer of said material in soft state, and will be characterized in that a multiplicity of short metal wire reinforcing elements are mixed in said material in soft state.

Preferably, the process is carried out in a way in which said material, such like mortar or concrete, is applied to the face of the sheet structure, e.g. by a trowel or any other similar tool, and where the reinforcing metal elements are mixed into the mix, before the latter is applied. But, by the use of a suitable projecting gun it is also possible to project said material onto the face of the sheet structure, whilst simultaneously projecting said reinforcing elements into the projected mortar or concrete mix.

The ballast element of the mortar or concrete mix used to form a building structure according to the invention may vary from fine sand to coarse aggregate depending on practical circumstances. Preferably the reinforcing elements are introduced and mixed into the mortar or concrete mix before applying, preferably during the mixing of the cement with ballast and water. When the length of the reinforcing elements is substantially less than the layer of applied metal in which they are distributed, the final building structure will have the wire elements uniformly distributed and randomly oriented therein. When however, the length of the reinforcing elements is at least of the same degree of magnitude as the layer of applied material, then the wire elements will not be randomly oriented, but preferentially around the directions parallel to the surface of the layer, this means, with an orientation statistically more concentrated around the parallel direction to the surface of the layer, then for a pure random orientation. For applying a layer of a thickness substantially more than the length of the reinforcing elements, and having these elements preferably parallel to the surface of the layer, it is possible to proceed by subsequent thin layers.

It is known that the reinforcing effect of the metal wire element reinforcement in mortar or concrete is the more pronounced as the metal is more finely distributed throughout the reinforced material. This is partly due to the fact that a given amount of reinforcement metal in the form of fine diameter wire elements has a greater adherence contact surface with the mortar then the same amount in the form of thick bars. For this reason, steel fiber reinforced concrete can reach a tensile strength of the same order of magnitude as concrete reinforced with long continuous reinforcement bars. Good results are obtained with steel wire element having a circular transverse section with an area not greater than 1 $mm^2$ and a length-to-diameter ratio between 50 and 200. As the reinforcement provided by the wire elements is based on the great tensile strength and modulus of elasticity of the wire material with respect to the reinforced material, it is clear that other materials than steel can be used, and that the preferred diameter and length-to-diameter ratio will depend on the kind of metal.

The reinforcing effect is also partly due to the great density of wire reinforcing elements in the reinforced material. This is because each wire element is responsible for a surrounding zone of influence to arrest an incipient crack in this zone. If a crack nevertheless succeeds in traversing one zone so as to meet the next zone with its wire element, the crack exerts there a tensile force which is the greater in proportion to the area already traversed and cracked. Therefore the zone of influence around each wire must have a cross-sectional area, perpendicular to the length of the wire, which is as small as possible. Assuming for the sake of simplicity that each surrounding zone is a cylinder of the length of the wire element, and that V is the volume of a sample of mortar or concrete, N the number of wire elements in the sample and L is the average length of each element, then the average transverse section area of the zones of influence surrounding the wire elements would be equal to V/NL. The wire reinforcing elements in the mortar or concrete for use in accordance with the present invention will have a very good reinforcing effect when:

$$(V/NL)\ 2\ cm^2$$

For reasons of economy, the wire elements will preferably have a transverse section area not greater than 1 $mm^2$. It must be noted however that the limits of 1 $mm^2$ and 2 $cm^2$ are not to be considered as absolute limits in the application of the invention, but rather as limits within which the reinforcement of the mortar or concrete is sure to be satisfactory in all circumstances likely to be met in practice.

SUMMARY OF THE INVENTION

This invention relates to a building structure of material which uses a water-activated binder, such as cement-mortar or concrete, and of a form having one thickness dimension much smaller than the other two dimensions perpendicular thereto. The cement-mortar or concrete type material has a plurality of short wire elements distributed therein for the purpose of reinforcing the material.

It is an object of this invention to provide a building structure which is well reinforced but yet the substrate sheet may be easily cut and folded.

DESCRIPTION OF THE DRAWINGS

Some embodiments of the invention will now be described by way of example and with reference to the accompanying drawings, in which:

FIG. 1 shows one face of a sheet provided with a mortar or concrete layer in accordance with the invention. In this example only one side of the sheet carries a layer of mortar or concrete. For the sake of clarity the drawing shows a part of the sheet where the layer of mortar or concrete has not been applied in order to show the structure of the substrate sheet. It comprises a sheet 1 of cardboard of a kind able to absorb water without damage, a series of horizontally running wires 2 on one side and a series of vertically running wires 3 on the other side. The cardboard sheet 1 is formed with regularly spaced apertures 4 through which the wire crossings are welded together. When applied, the mortar or concrete flows through the apertures 4 and envelopes the crossings of the wires 2, 3 and 5 (see FIG. 2). This results, after drying, in a good adherence of the mortar or concrete layer to the substrate sheet.

In a typical application of the invention a mortar mix is employed having the following composition:

Portland cement: according to Begian specification P400.

Sand: concrete sand 0–2 mm.

Wires: diameter 0.35 mm, overall length 30 mm.

Sand-cement ratio: between 0.5 and 3.0 to 1.

Water-cement ratio: between 0.3 and 0.6 to 1.

Concentration of wire elements: 1 to 2% by volume.

The most suitable length-to-diameter ratio of the wire elements is in the range of between 50 to 200 to 1. Preferably the ends of the wires are of incurved form, leaving however a substantially straight contral part of at least half the wire length. Care must be taken however that the end incurvations are not of a form which encourages entanglement of the elements during mixing. Straight wires may also be used, and the wires may be of flat or round cross section.

The mortar or concrete can be applied either by hand e.g. with a trowel, or (if sufficiently fluid) by a high-pressure gun. Suitable mortar guns are well known in the application of plaster. They comprise a pump which elevates the mix to high pressures of 20–30 atmospheres, and a gun which projects the mix. There are types which are designed especially for moist and coarse aggregate, even up to 30 mm diameter of the aggregate, such as the type MIXOKRET MZ 150 DK of the firm Putzmeister, which can be used in conjunction with a high-pressure conduit-hose of 50 mm diameter. Care must of course be taken that the wire reinforcing elements do no obstruct the opening of the gun. If necessary, the wire elements and the mortar or concrete mix can be projected separately byt simultaneously towards the same point of impact, for instance with the help of a blower.

Projecting the mortar or concrete and the wire elements in this way has the advantage of leaving a rough surface with projecting wire extremities, which provides a good base of adherence for a subsequent finishing layer of plaster, plastic resin, tiles or the like, The mix may however when spread by hand present a finished aspect. In the latter case the wire elements are, before spreading, mixed up with the mortar or concrete mix until they are uniformly distributed therein and randomly oriented. Then the mix is spread on the substrate sheet structure so that the final structure will have the wire elements uniformly distributed and randomly oriented therein. Although the outer skin of the layer has then its wire elements oriented in the plane of the outer surface it may still be said that the wire elements are substantially uniformly distributed and randomly oriented. But it is clear that for small thicknesses of the layer, the wire elements will be preferentially oriented in the plane of the layer.

Figure 1:
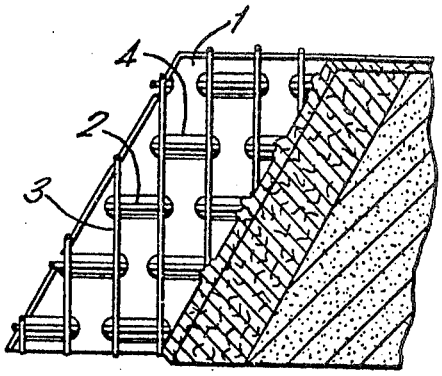
FIGS. 1 and 2 are views of the two faces of a substrate sheet having a single layer of mortar or concrete applied thereto in accordance with the invention.
Figure 2:
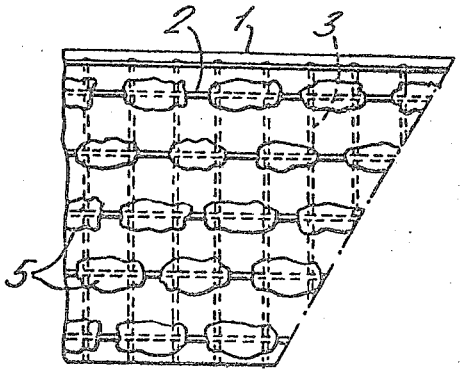
Figure 3:
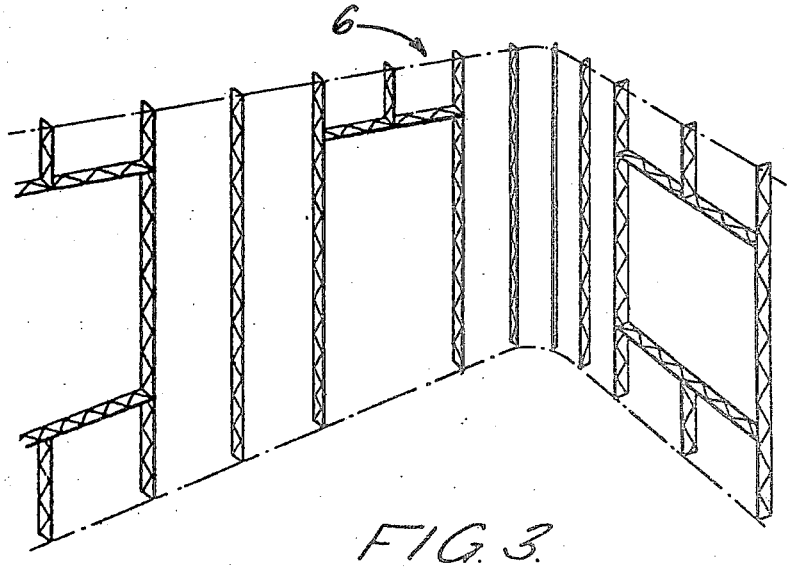
FIG. 3 shows a framework for supporting the substrate sheets of part of a building structure according to the invention.
Figure 4:
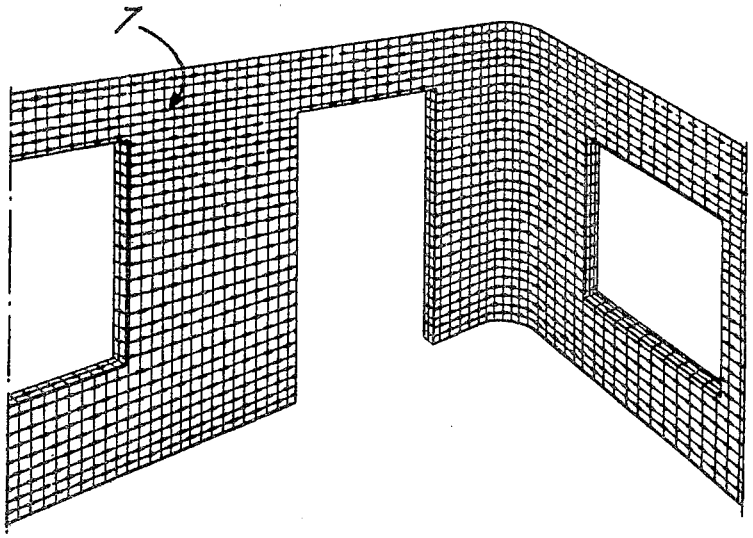
FIG. 4 shows the substrate sheet structure supported by the framework of FIG. 2 and with the substrate sheets in position.
Figure 5:
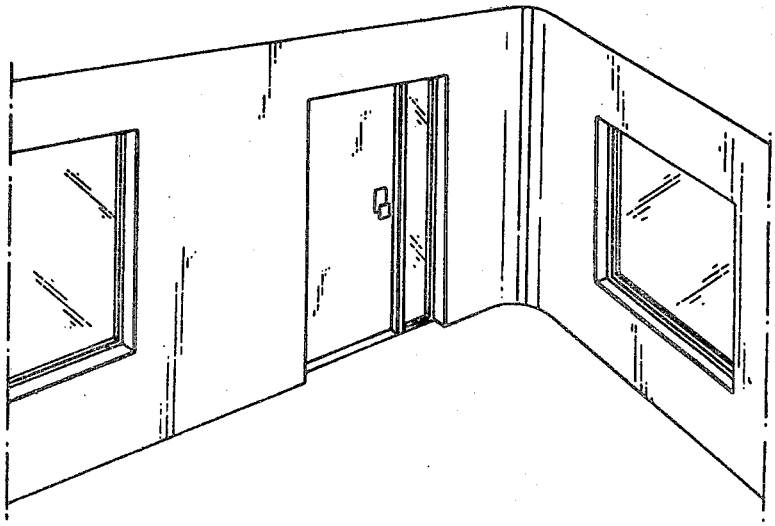
FIG. 5 shows the finished structure.

The way of making a structure in the form of a small cabin or holiday-cottage is shown in FIGS. 3 to 5. Firstly a number of posts are erected and connected with jambs and bars to form a framework 6. Subsequently a number of substrate sheets 7 are cut and folded in a suitable form and fixed side by side to the framework (FIG. 4). In this way the complete form of the cottage is shaped, and the openings for windows, doors and also such irregularities as window-sets and doorsteps are formed. Finally the wire-reinfoced mortar or concrete mix is applied to the substrate sheet structure and the result is shown in FIG. 5. It is to be noted that the outer walls of the cottage are formed by two inner and outer sets of parallel substrate sheets each carrying a layer of mortar or concrete on the side remote from the other so as to leave a cavity between the sheets which can be filled with insulating material. The partitioning walls inside the cottage may consist of only one layer of sheets, covered with a mortar or concrete layer on each side.

Waterproof structures such as monolithic swimming pools may be formed in acccordance with the invention. Then one side of the substrate sheet structure is covered with wire-reinforced mortar or concrete whilst the other side (the inner surface of the swimming pool) is then covered with a layer of which at least the surface material is waterproof, for instance an epoxycement.

The principles of the invention are not only applicable to the provision of in situ complete structures such as buildings. The invention can also be applied to the provision of building elements such as flat panels, corner-shaped elements or other articles capable of being made of reinforced mortar or concrete.

What I claim is:

1. A three dimensional building structure of a form having the thickness dimension much smaller than the other two dimensions comprising:

a framework in the general shape of a building structure, a plurality of non-rigid foldable and cuttable wire-reinforcing cardboard lath sheets of a nature such that a hardenable surfacing material utilizing a wateractivated cement binder will adhere thereto secured to said framework, said lath sheets being folded and conformed and arranged in side-by-side manner so as to conform to said framework, a layer of said water-activated cement binder surfacing material applied to at least one face of said lath sheet structure and reinforced throughout by a plurality of randomly distributed wire elements having cross-sectional areas of less than about 1 $mm^2$ and an aspect ratio within the range of about 50 to 100, at least some of said reinforcing elements projecting from the surface of said layer of surfacing material remote from said substrate sheet structure, and a layer of finishing material applied over said surface and anchored at least in part by said projecting reinforcing elements being partially embedded in each of said layers.

2. A building structure according to claim 1, in which said reinforcing elements are of a length substantially less than the thickness of said layer of surfacing material.

3. A building structure according to claim 1 which comprises a plurality of interconnected substrate sheets over which said hardenable surfacing material layer extends in continuous fashion.

4. A building structure as in claim 1 and wherein at least the outer surface region of said finishing material is substantially waterproof.

5. A process for making a building structure of a hardenable material which uses a water-activated binder such as cement-mortar or cement, which comprises:

providing a plurality of non-rigid foldable and cuttable wire-reinforced cardboard lath sheets to which hardenable material will adhere in the form of said building structure;

erecting a framework adapted to receive said lath sheets secured thereto;

folding said lath sheets and fixing them in side-by-side relationship on said framework so as to form an incurved lath-sheet structure;

applying to at least one face of said incurved lath-sheet structure a layer of said hardenable material in a soft state, said hardenable material having a plurality of randomly distributed short metal wire reinforcing elements having an aspect ratio of about 50 to 200 mixed therein, said material being applied in such a manner that at least some of said reinforcing elements project from the surface of said applied material, and applying a layer of a hardenable finishing material to said surface whereby said finishing layer is anchored to said surface at least in part by said projecting elements being embedded in each of said layers.

6. A process as in claim 5 wherein said material is applied to said incurved lath sheet structure by projection from a pressure gun.

7. A process as in claim 5 and wherein said hardenable material and said reinforcing elements are applied separately by projection from a pressure gun.

* * * * *